US005628216A

United States Patent [19]

Qureshi et al.

[11] Patent Number: 5,628,216

[45] Date of Patent: May 13, 1997

[54] LOCKING DEVICE

[75] Inventors: Khurshid A. Qureshi; Ilia Petkov; Nasir Uddin, all of Colorado Springs, Colo.

[73] Assignee: Schlage Lock Company, San Francisco, Calif.

[21] Appl. No.: 372,790

[22] Filed: Jan. 13, 1995

[51] Int. Cl.[6] ..... E05B 47/00

[52] U.S. Cl. ..... 70/279; 70/277; 70/280; 292/201; 292/DIG. 61

[58] Field of Search ..... 70/275, 277–280, 70/281–283, 472; 292/201, DIG. 61

[56] References Cited

U.S. PATENT DOCUMENTS

| | | | |
|---|---|---|---|
| 777,885 | 12/1904 | Dieringer | 70/472 |
| 3,733,861 | 5/1973 | Lester . | |
| 3,893,723 | 7/1975 | Boule . | |
| 4,019,355 | 4/1977 | Germanton . | |
| 4,135,377 | 1/1979 | Kleefeldt | 70/280 |
| 4,149,212 | 4/1979 | Willach . | |
| 4,665,727 | 5/1987 | Uyeda . | |
| 4,744,021 | 5/1988 | Kristy . | |
| 4,754,625 | 7/1988 | McGourty et al. . | |
| 4,760,393 | 7/1988 | Mauch . | |
| 4,770,012 | 9/1988 | Johansson et al. . | |
| 4,800,741 | 1/1989 | Kerschenbaum et al. . | |
| 4,802,353 | 2/1989 | Corder et al. . | |
| 4,821,521 | 4/1989 | Schüler | 70/282 |
| 4,843,851 | 7/1989 | Frolov . | |
| 4,899,562 | 2/1990 | Gartner et al. . | |
| 4,901,545 | 2/1990 | Bacon et al. . | |
| 4,917,022 | 4/1990 | Ogasawara et al. . | |
| 4,920,773 | 5/1990 | Surko | 70/224 |
| 4,949,562 | 8/1990 | Thorncraft | 70/277 |
| 4,949,563 | 8/1990 | Gerard | 70/275 |
| 4,984,441 | 1/1991 | Mauer . | |
| 4,992,785 | 2/1991 | Lewiner et al. . | |
| 5,018,375 | 5/1991 | Tully | 70/277 |
| 5,027,629 | 7/1991 | Liu | 70/280 |
| 5,033,282 | 7/1991 | Gartner et al. . | |
| 5,083,122 | 1/1992 | Clark . | |
| 5,091,771 | 2/1992 | Bolan et al. . | |
| 5,094,093 | 3/1992 | Ben-Asher . | |
| 5,107,258 | 4/1992 | Soum . | |
| 5,113,675 | 5/1992 | Uyeda | 70/283 |

(List continued on next page.)

FOREIGN PATENT DOCUMENTS

| | | |
|---|---|---|
| WO90/06024 | 5/1990 | European Pat. Off. . |
| 2596096 | 9/1987 | France . |
| 2635554 | 2/1990 | France . |
| 4-11543 | 1/1990 | Japan . |

*Primary Examiner*—Steven N. Meyers
*Assistant Examiner*—Gary Estremsky
*Attorney, Agent, or Firm*—Dickstein Shapiro Morin & Oshinsky LLP

[57] ABSTRACT

A locking device is disclosed, comprising a locking mechanism having a locked position and an unlocked position, a hollow plunger member having a central axis, the hollow plunger member being engaged with the locking mechanism to move the locking mechanism alternatively into the locked and unlocked positions upon reciprocating linear motion of the hollow plunger member in first and second directions along its central axis, and a motor having a shaft disposed coaxial with the central axis of the hollow plunger member is disclosed. In one embodiment, the locking device further comprises a spring having first and second ends, the first end being fixed to the motor shaft, and a pin fixed to the hollow plunger member for engaging the second end of the spring such that when the motor shaft rotates in a third direction the hollow plunger member moves in the first direction and when the motor shaft rotates in a fourth direction the hollow plunger member moves in the second direction. In another embodiment, the locking device further comprises a threaded member disposed on the motor shaft and a threaded surface disposed at an interior of the hollow plunger member to engage the threaded member such that when the motor shaft rotates in a third direction the hollow plunger member moves in the first direction and when the motor shaft rotates in a fourth direction the hollow plunger member moves in the second direction.

12 Claims, 15 Drawing Sheets

U.S. PATENT DOCUMENTS 5,136,870 8/1992 Gartner et al. .
5,196,841 3/1993 Harder et al. .
5,199,288 4/1993 Merilainen et al. .
5,216,909 6/1993 Armoogam .
5,328,218 7/1994 Brusasco ..... 292/201
5,337,588 8/1994 Chhatwal .
5,339,662 8/1994 Goldman .
5,373,752 12/1994 Schlagwein ..... 292/201
5,421,178 6/1995 Hamel ..... 70/472
5,437,174 8/1995 Aydin ..... 70/280
5,447,047 9/1995 Lin ..... 70/472

LOCKING DEVICE

BACKGROUND OF THE INVENTION

1. Field of the Invention

The present invention relates generally to a locking device and, in particular, an electronic locking device.

2. Description of the Related Art

Various electronic locking devices have been suggested for controlling access to large numbers of areas through doors by a large number of individuals. Many of these devices utilize card readers, push-buttons, dials, etc. to activate the locking device.

One such device is disclosed in U.S. Pat. No. 5,038,122 issued to Clark. The device disclosed in Clark opens a lock in response to a correct code entered through a keyboard and/or to a chronological schedule enabled by a clock marking real time. An LED provides a wireless link to a hand-held printer so that the device may be programmed with access codes and time schedules. The printer also prints out a list of users and times of entry.

One problem with the device disclosed in Clark is that the electromechanical drive system is difficult to assemble because of the engagement of the spring through a set screw. The spring also has a compound shape with two different pitch and hook formations at the end of the spring which again makes alignment and assembly of the system very difficult. Another problem with the device disclosed in Clark is that there is a significant amount of friction generated by the rotary and linearly moving components which results in increased electric power consumption and hence reduced battery life.

SUMMARY OF THE INVENTION

The present invention is directed to a locking device that substantially obviates one or more of the problems due to the limitations and disadvantages of the related art. Features and advantages of the invention will be set forth in the description which follows, and in part will be apparent from the description, or may be learned by practice of the invention. Objectives and other advantages of the invention will be realized and attained by the apparatus and system particularly pointed out in the written description and claims hereof as well as the appended drawings.

To achieve these and other advantages and in accordance with the purpose of the invention, as embodied and broadly described, the invention provides for a locking device, comprising: a locking mechanism having a locked position and an unlocked position; a hollow plunger member having a central axis, the hollow plunger member being engaged with the locking mechanism to move the locking mechanism alternatively into the locked and unlocked positions upon reciprocating linear motion of the hollow plunger member in first and second directions along its central axis; a motor having a shaft disposed coaxial with the central axis of the hollow plunger member; a spring having first and second ends, the first end being fixed to the motor shaft; and engaging means fixed to the hollow plunger member for engaging the second end of the spring such that when the motor shaft rotates in a third direction the hollow plunger member moves in the first direction and when the motor shaft rotates in a fourth direction the hollow plunger member moves in the second direction.

To further achieve these and other advantages and in accordance with the purpose of the invention, as embodied and broadly described, the invention also provides for a locking device, comprising: a locking mechanism having a locked position and an unlocked position; a hollow plunger member having a central axis, the hollow plunger member being engaged with the locking mechanism to move the locking mechanism alternatively into the locked and unlocked positions upon reciprocating linear motion of the plug member in first and second directions along its central axis; a motor having a shaft disposed coaxial with the cental axis of the hollow plunger member; a threaded member disposed on the motor shaft; and a threaded surface disposed at an interior of the hollow plunger member to engage the threaded member such that when the motor shaft rotates in a third direction the hollow plunger member moves in the first direction and when the motor shaft rotates in a fourth direction the hollow plunger member moves in the second direction.

BRIEF DESCRIPTION OF THE DRAWINGS

The accompanying drawings, which are included to provide a further understanding of the invention and are incorporated in and constitute a part of this specification, illustrate several embodiments of the invention and together with the written description serve to explain the principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1:
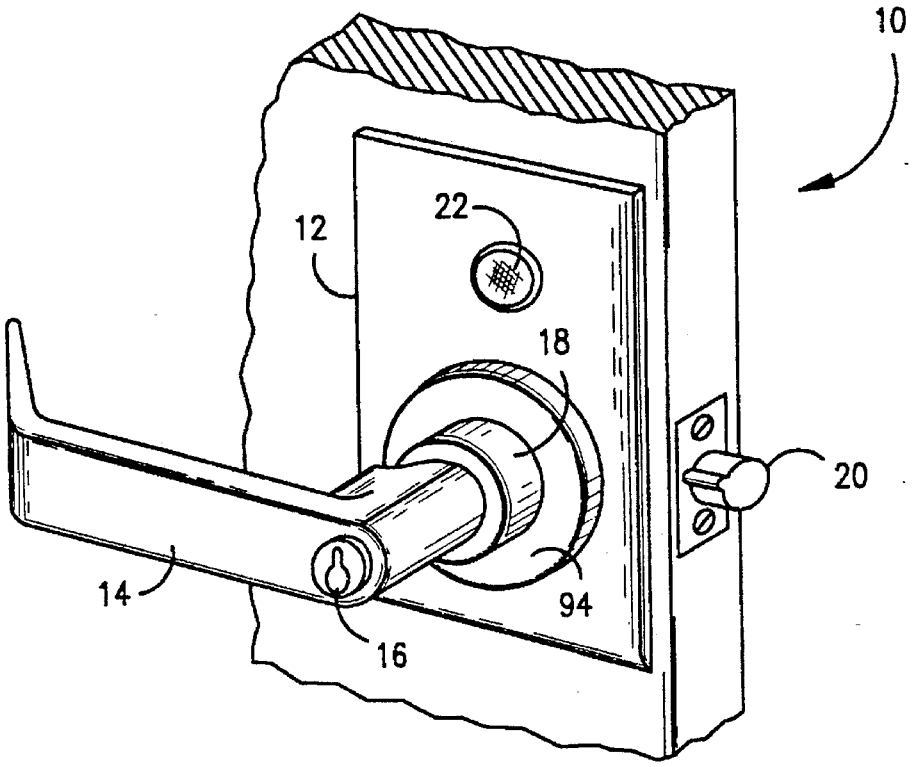
FIG. 1 is an isometric front view of a locking device according to a first embodiment of the present invention mounted on a door.
Figure 2:
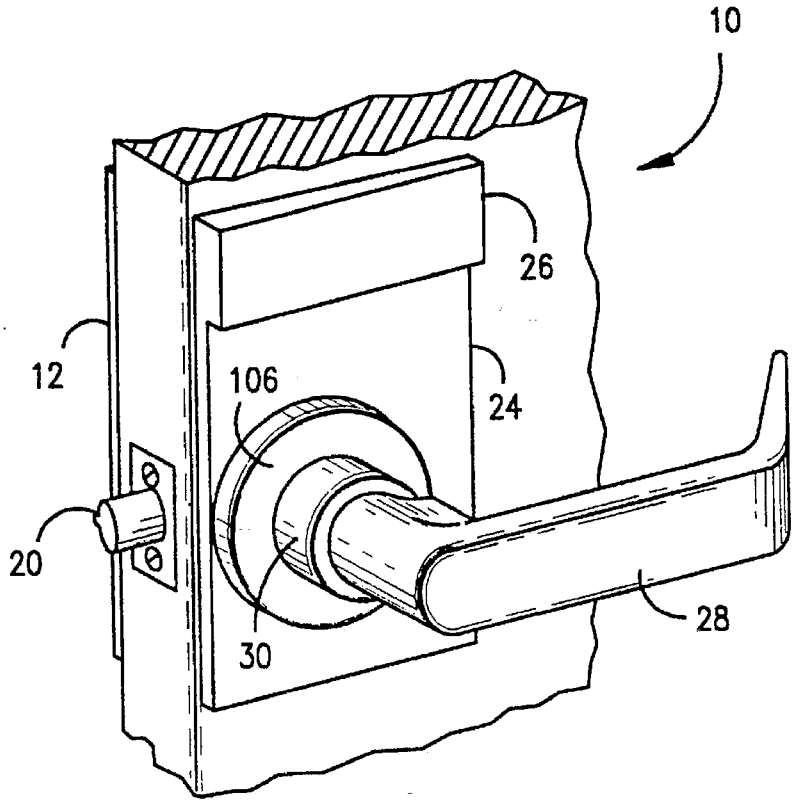
FIG. 2 is an isometric rear view of the locking device of FIG. 1.

A first embodiment of the locking device according to the present invention is shown in FIGS. 1 and 2 and is designated generally by reference numeral 10. As embodied herein and referring to FIGS. 1 and 2, the locking device 10 comprises a front cover plate 12, a front handle 14, a key barrel 16, a front collar 18, a front rose 94, a door bolt 20, a sensor 22, a rear cover plate 24, a control electronics housing 26, a rear handle 28, a rear collar 30, and a rear rose 106.

The locking device 10 according to the first embodiment is a cylindrical door lock. As shown in FIGS. 1 and 2, the locking device 10 is sized and shaped to easily replace standard mechanical cylindrical door locks. Thus, modifications to the door to accommodate the locking device 10 are either very minor or unnecessary. As also shown in FIGS. 1 and 2, the control electronics housing 26 is situated on the rear (unsecured) side of the door such that the control electronics which are housed therein are not accessible to unauthorized persons.

The sensor 20 can comprise, for example, an infrared or RF receiver for receiving an input code generated by an external source. As will be discussed in more detail below, this input code is used by the control electronics of the locking device 10 to operate a locking mechanism. It is contemplated that the sensor 22 can be replaced with a keypad, bar code reader, pattern recognition device, voice recognition device, or the like for generating the input code. Such devices are well known in the art, one such device being the Touch Memory® device manufactured by Dallas Semiconductor of Dallas, Tex. and any number of them can be used with the present invention.

Figure 3:
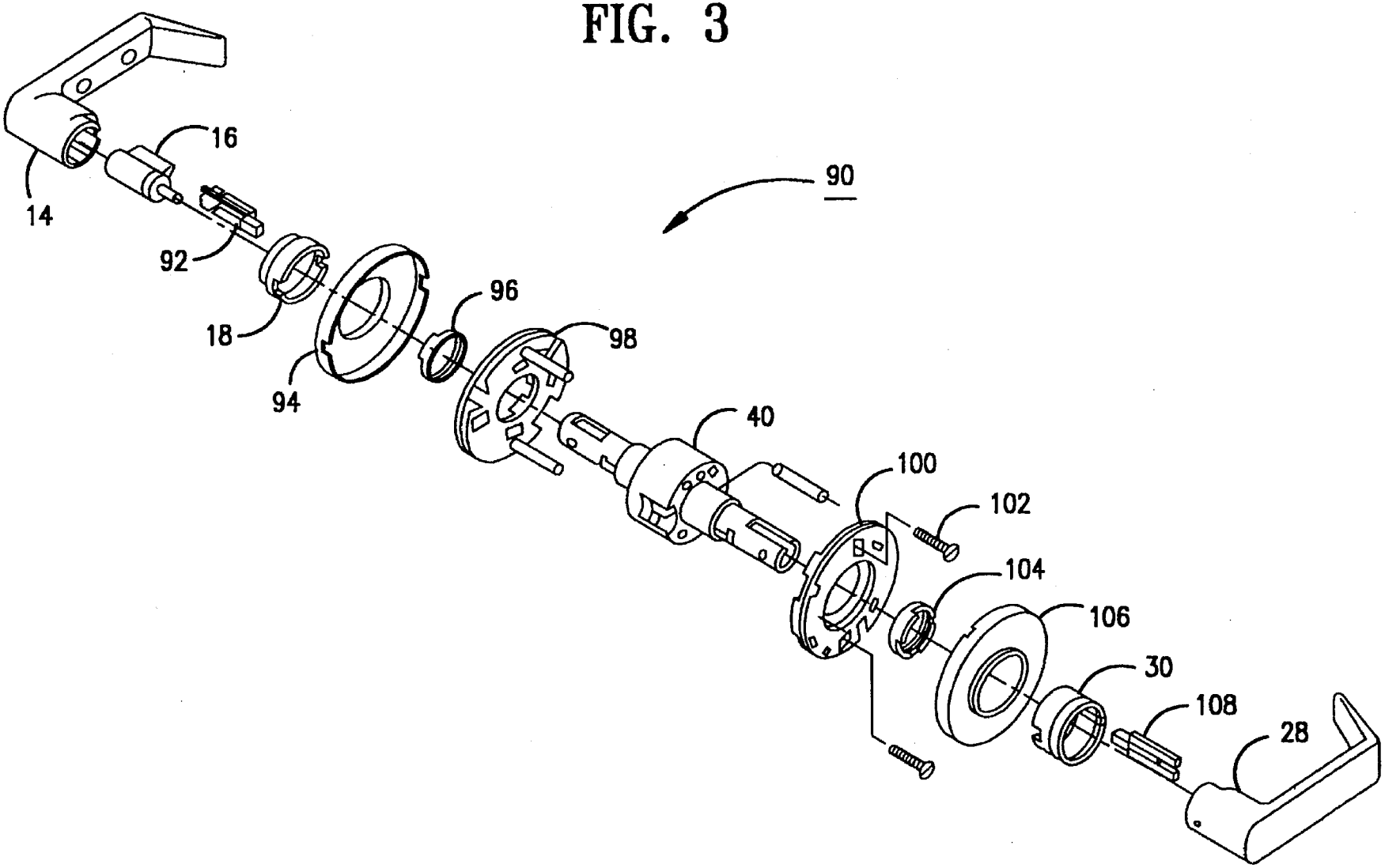
FIG. 3 is an exploded view of a trim assembly of the locking device of FIGS. 1 and 2.

FIG. 3 illustrates a trim assembly 90 of the locking device 10. In addition to the components shown in FIGS. 1 and 2, the trim assembly 90 comprises a handle guide 92, a bushing 96, a front spring cage 98, a chassis assembly 40, a rear spring cage 100, screws 102, a bushing 104, and a rear handle guide 108. The components of the trim assembly 90, except for the chassis assembly 40, are conventional lock components which are commercially available and, therefore, will not be described in detail.

Figure 4A:
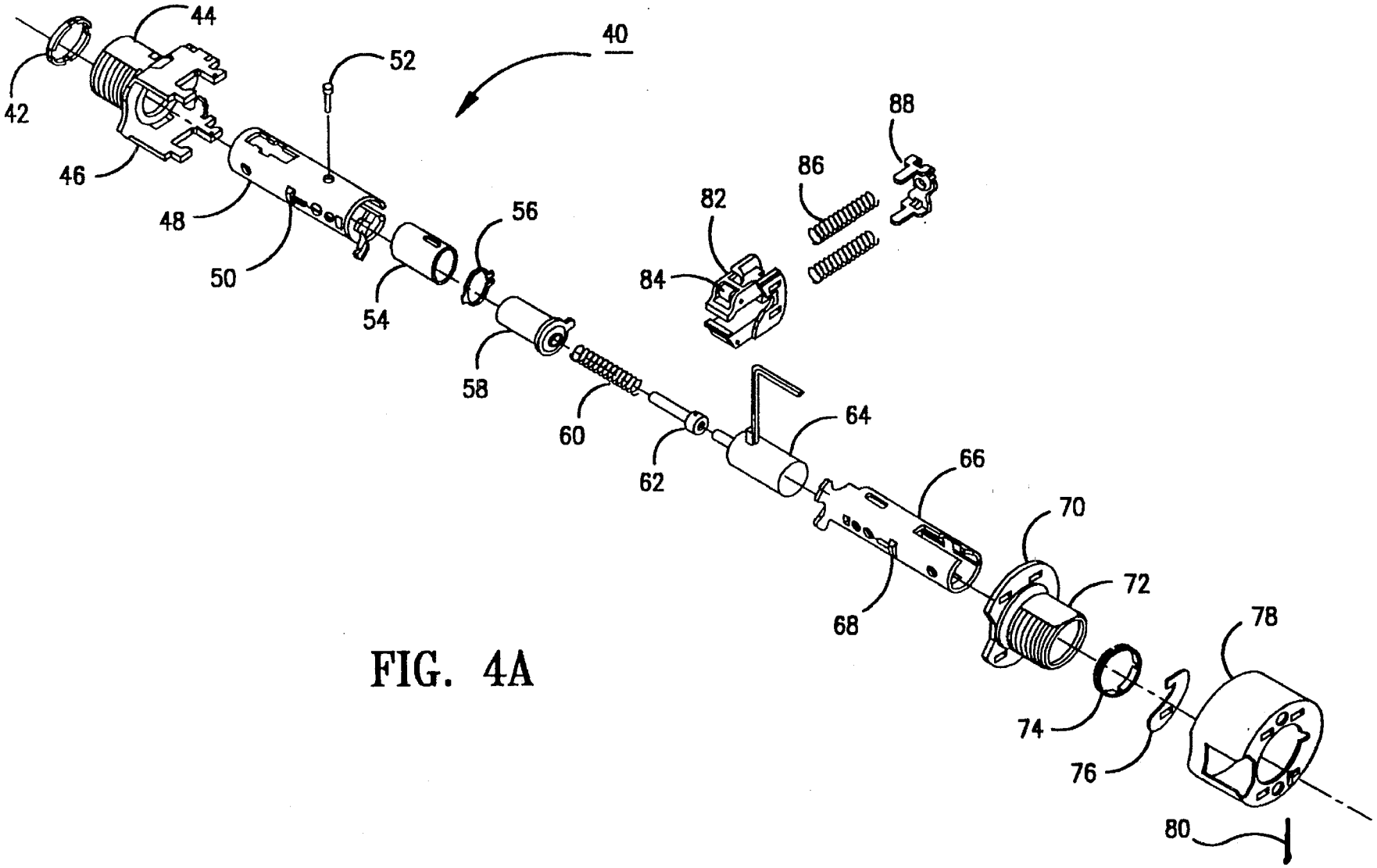
FIG. 4A is an exploded view of a chassis assembly of the locking device of FIGS. 1 and 2.
Figure 4B:
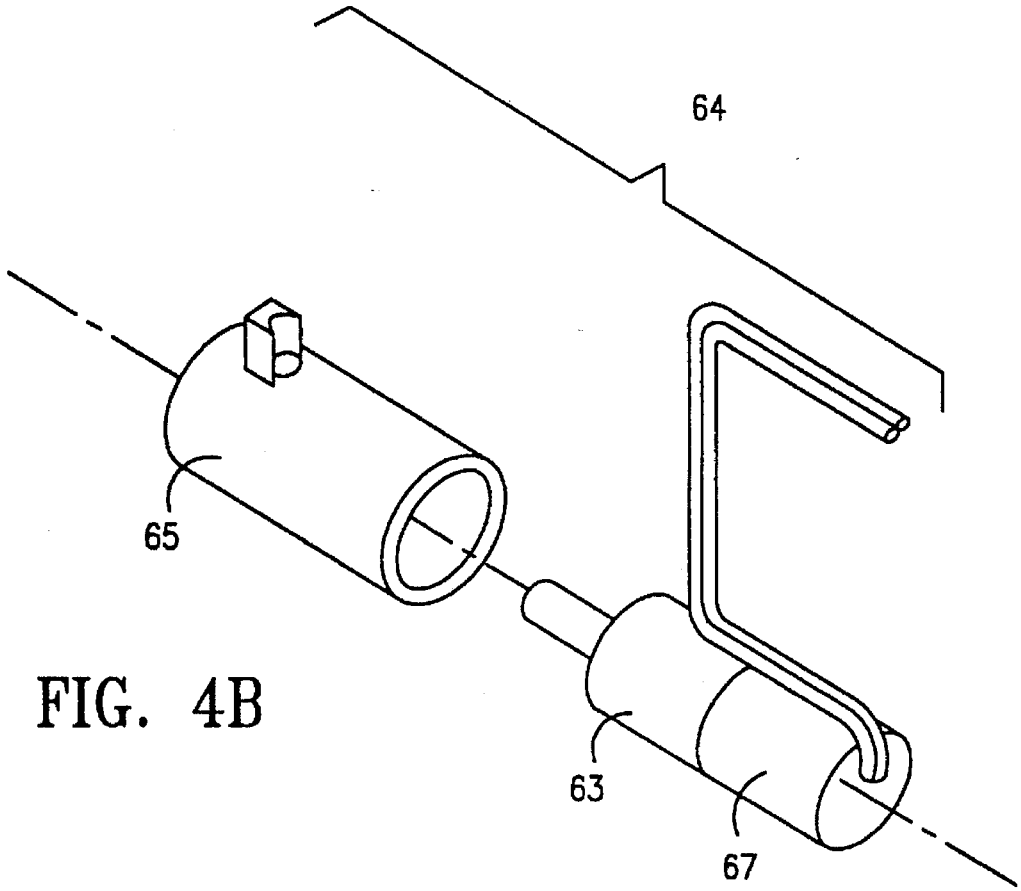
FIG. 4B is an exploded view of the motor assembly of FIG. 4A.
Figure 6B:
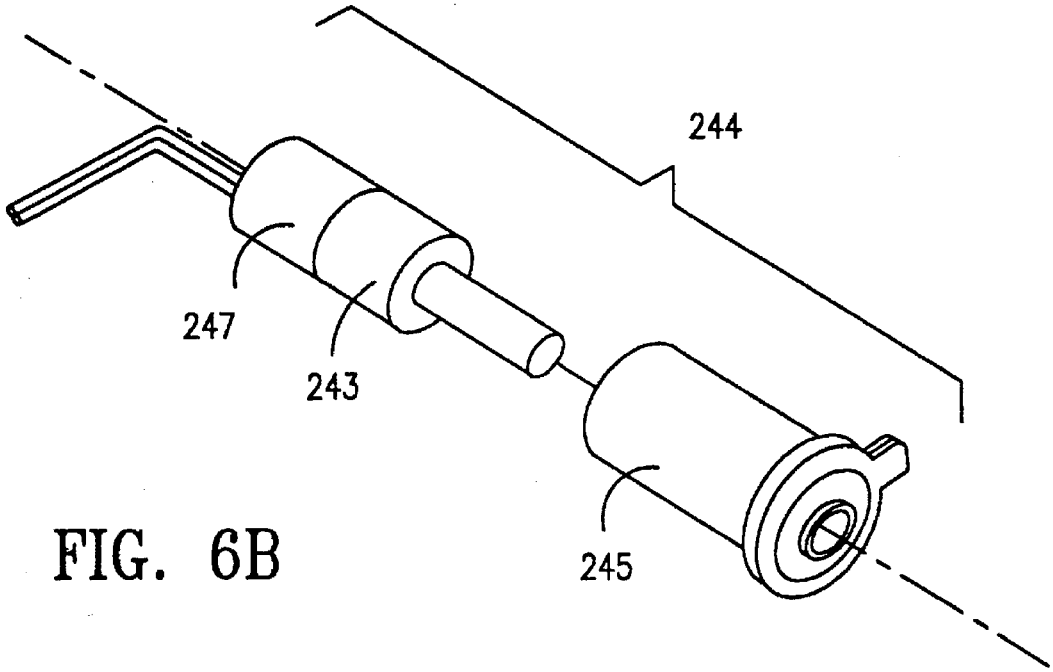
FIG. 6B is an exploded view of the motor assembly of FIG. 6A.

FIGS. 4A, 4B, 5A, and 5B illustrate the various components of the chassis assembly 40. As shown in FIG. 4A, the chassis assembly 40 comprises a hub bushing 42, a hub 44, a frame 46, a spindle 48, a catch 50, a pin 52, a plug 54, a washer 56, a plug 58, a spring 60, a guide member 62, a motor assembly 64, a spindle 66, a catch 68, a flange 70, a hub 72, a hub bushing 74, a retaining clip 76, a housing 78, a cotter pin 80, a slide 82, rollers 84, slide springs 86, and a spring seat 88. As shown in FIG. 4B, the motor assembly 64 includes a motor 67, a gear head 63, and on electrically insulating shroud 65. The gear head 63 is coupled to the motor 67 such that the shaft of the gear head 63 turns with the shaft of the motor 67 to provide increased torque as is known in the art. The shroud 65 is made of plastic or other electrically insulating material to prevent short circuiting of the motor 67 and facilitate assembly of the motor assembly 64 into the spindle 66. The components of the chassis assembly 40, except for the plug 58, the spring 60, the guide member 62, and the motor assembly 64, are conventional lock components which are also commercially available and, therefore, will not be described in detail.

Figure 5A:
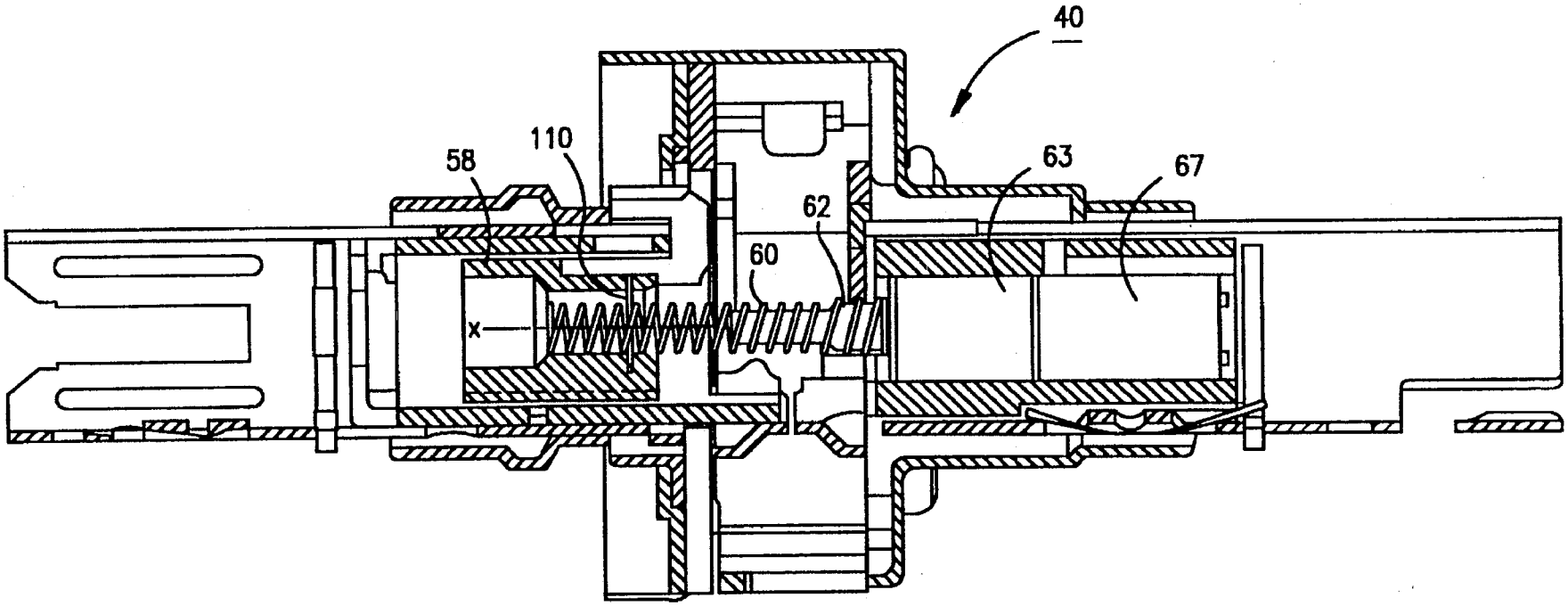
FIG. 5A is a side, cutaway view of the chassis assembly of FIG. 4 in a locked position.
Figure 5B:
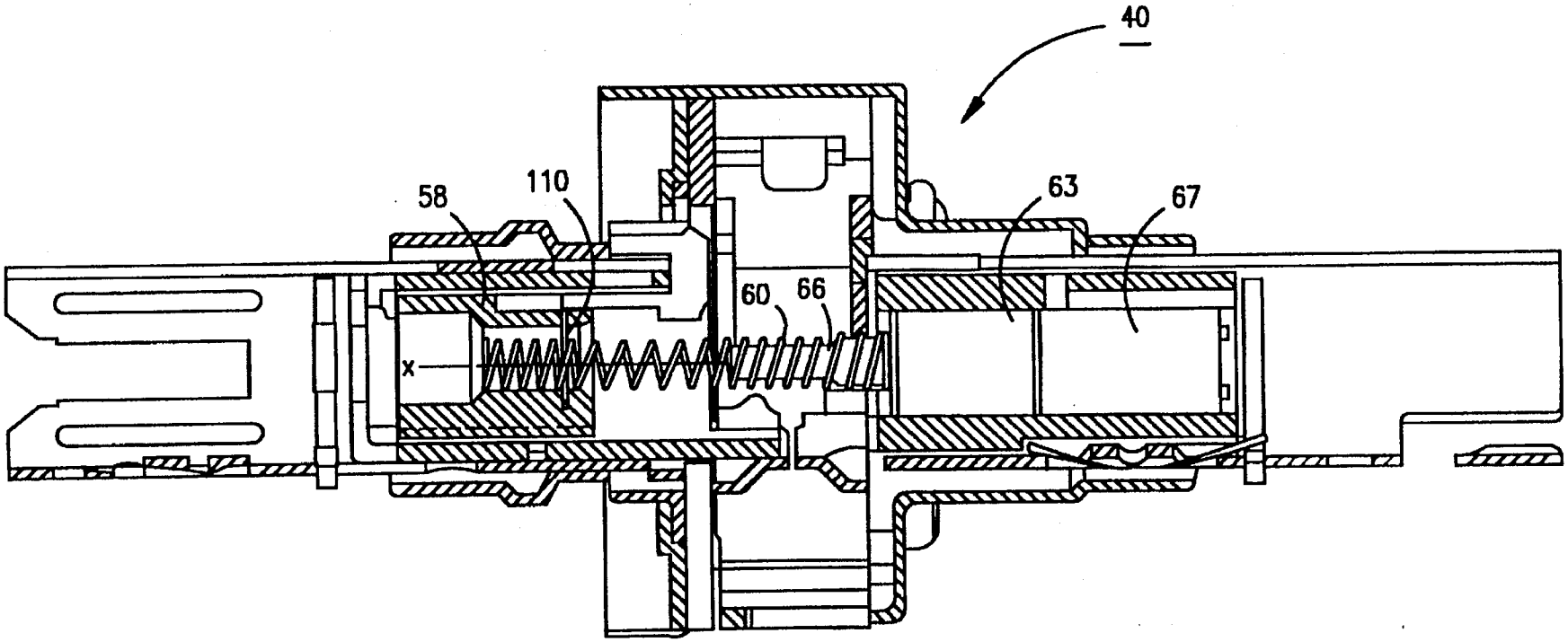
FIG. 5B is a side, cutaway view of the chassis assembly of FIG. 4 in an unlocked position.
Figure 6A:
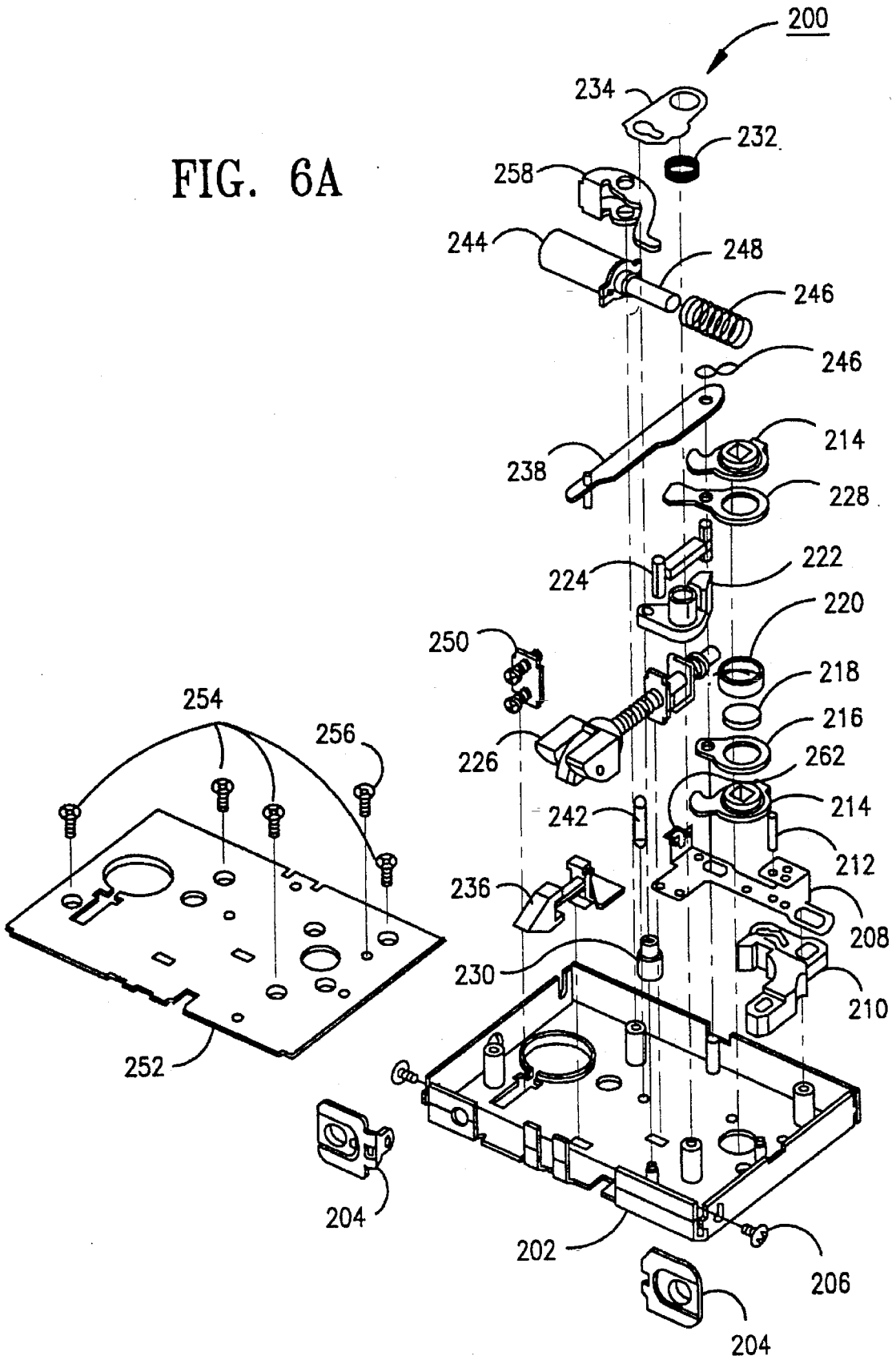
FIG. 6A is an exploded view of a locking device according to a second embodiment of the present invention.

As shown in FIGS. 5A and 5B, the plug 58 is a hollow member having a central axis X which is coaxially aligned with the shaft of the gear head 63 and, thus, with the shaft of the motor 67. The plug 58 is engaged with the slide 82, the rollers 84, the slide springs 86, the spring seat 88, and the door bolt 20 to move these components in a conventional manner alternatively into locked and unlocked positions upon reciprocating linear motion of the plug 58 along the central axis X. The guide member 62 is fixed to the shaft of the gear head 63 via, for example, a set screw, and extends therefrom as shown. Alternatively, the guide member 62 can be integrally formed with the shaft. The spring 60 is fixed to the guide member 62 at one end such the spring 60 rotates with the shaft of the gear head 63 and, thus, with the shaft of the motor 64. The motor 64 is preferably a low power DC motor such as a Micromotors 1212 series motor.

As also shown in FIGS. 5A and 5B, the chassis assembly 40 further comprises a pin 110 fixed to the plug 58. Preferably, the pin 110 extends radially from the interior surface of the plug 58 to perpendicularly intersect the central axis X. However, other configurations of the pin 110 are contemplated. For example, the pin 110 can extend radially from the interior surface of the plug 58 to intersect the central axis X at an angle other than 90 degrees. Further, the pin 110 can be mounted in front of as opposed to inside the plug 58. Still further, the pin 110 need not traverse the entire inside diameter of the plug 58, just so long as the pin 110 is long enough to engage the coils of the spring 60.

During rotation of the motor shaft in a first direction, the pin 110 engages the free end of the spring 60 such that the plug 58 moves toward the motor 67 placing the locking device 10 in the locked position shown in FIG. 5A. During rotation of the motor shaft in a second direction opposite the first direction, however, the pin 110 engages the free end of the spring 60 such that the plug 58 moves away from the motor 67 placing the locking device 58 in the unlocked position shown in FIG. 5B. Thus, the spring 60 translates the rotary motion of the shaft of the motor 67 into a linear motion of the plug 58 to lock and unlock the locking device 10.

If during rotation of the shaft of the motor 67 in the first direction the plug 58 is prevented from moving to the locked position by an external force, e.g., someone resting on the door handle 14 while the motor shaft is turning, the motor 67 will cause the spring 60 to compress as the plug 58 remains stationary. Then, once the external force is removed, the plug 58 will return to the locked position. Similarly, if during rotation of the shaft of the motor 67 in the second direction the plug 58 is prevented from moving to the unlocked position by an external force, the motor 67 will cause the spring 60 to stretch as the plug 58 remains stationary. Then, once the external force is removed, the plug 58 will return to the unlocked position.

Preferably, the pitch of the spring 60 is selected in accordance with the rotational speed of the gear head shaft such that the plug 58 moves along its central axis X at a desired rate. For example, if the gear head shaft rotates at 1,000 RPM, the spring 60 can have a pitch of 0.10–0.20 inch. Further, during rotation of the motor shaft, the guide member 62 guides the spring 60 into and out of the plug 58 to thereby facilitate engagement of the spring 60 by the pin 110.

A second embodiment of the locking device according to the present invention is shown in FIGS. 6A, 6B, 7A, and 7B and is designated generally by reference numeral 200. As embodied herein and referring to FIGS. 6A, 6B, 7A, and 7B, the locking device 200 comprises a lock case 202, face plate tabs 204, face plate tab screws 206, an electrified link 208, a locking catch 210, a link pin 212, retractor hubs 214, a retractor rocker 216, a blocking plate 218, a retractor hub spacer 220, a retractor crank 222, a retractor link 224, a latch bolt assembly 226, a retractor lever 228, a fire door fuse 230, a hub spring 232, a fire door catch 234, an auxiliary latch bolt assembly 236, an auxiliary stop 238, a stop spring 240, a standoff post 242, a motor assembly 244 including a motor 247, a gear head 243 and an electrically insulating shroud 245, a guide member 248, a cylinder anchor assembly 250, a lock case cover 252, case cover screws 254, a lock handing screw 256, a transfer lever 258, a pin 260, and a plug 262.

The locking device 200 according to the second embodiment is a mortise door lock. As with the first embodiment, the locking device 200 is sized and shaped to easily replace standard mechanical mortise door locks. Further, the components of the locking device 200, except for the motor assembly 244, the spring 246, the guide member 248, the pin 260, and the plug 262, are conventional lock components which are commercially available and, therefore, will not be described in detail. Preferably, the motor assembly 244, the spring 246, the guide member 248, the pin 260, and the plug 262 of the locking device 200 are structurally and functionally similar to the motor assembly 64, the spring 60, the guide member 62, the pin 110, and the plug 58, respectively, of the locking device 100 of the first embodiment.

For example, the plug 262 is a hollow member having a central axis X which is coaxially aligned with the shafts of the gear head 243 and motor 247. The plug 262 is engaged with the electrified link 208 to move the link in a conventional manner alternatively into locked and unlocked positions upon reciprocating linear motion of the plug 262 along the central axis X. The guide member 248 is fixed to the shaft of the gear head 243 via, for example, a set screw, and extends therefrom as shown. Alternatively, the guide member 248 can be integrally formed with the shaft. The spring 260 is fixed to the guide member 248 at one end such that the spring 260 rotates with the shaft of the gear head 243 and, thus, with the shaft of motor 247. The motor 247 is preferably a low power DC motor. The pin 260 is fixed to the plug 262 and extends radially from the interior surface of the plug 262 to perpendicularly intersect the central axis X. As was the case with the first embodiment, however, other configurations of the pin 260 are contemplated.

Figure 7A:
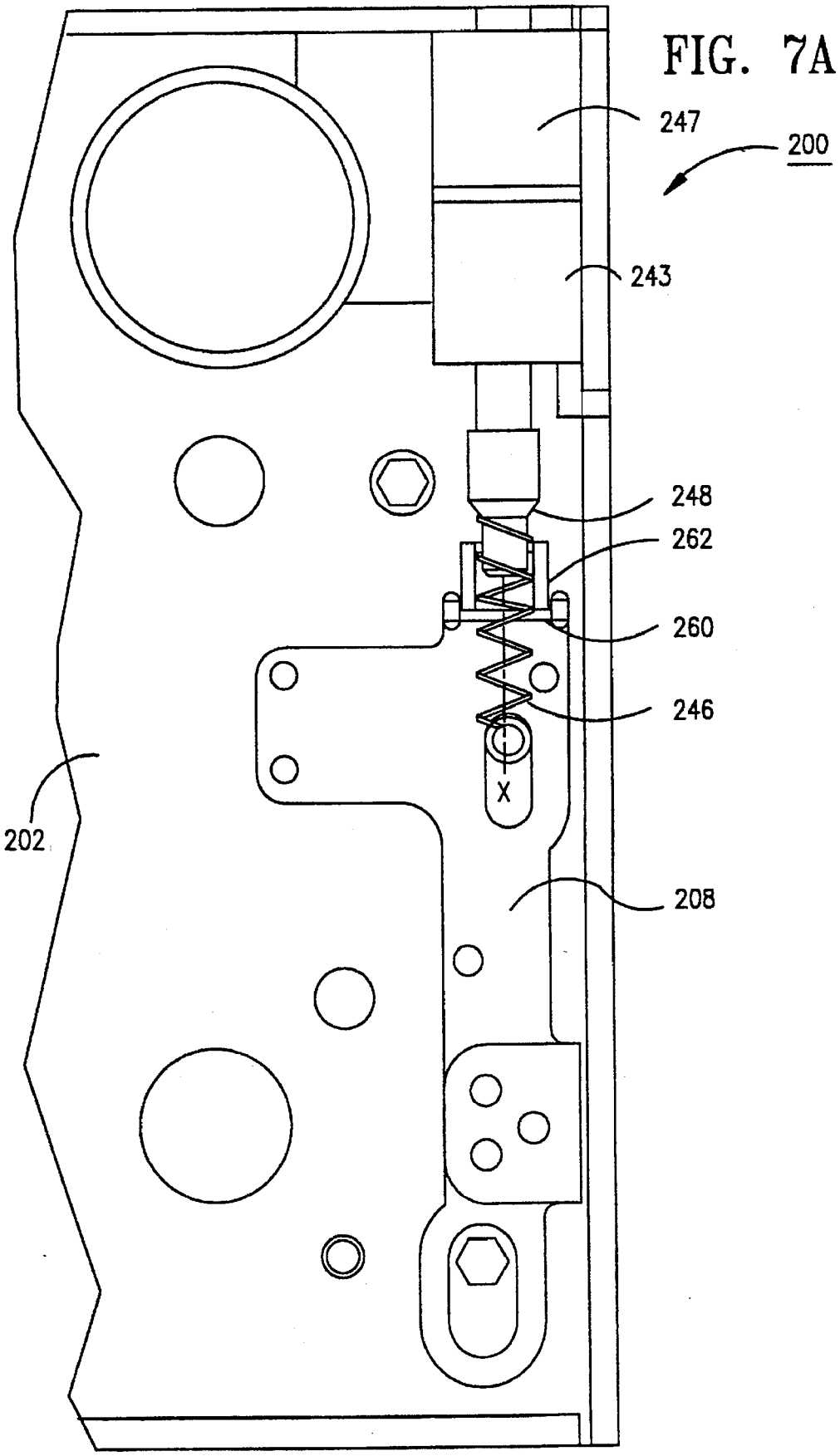
FIG. 7A is a partial side view of the locking device of FIG. 6 in a locked position.
Figure 7B:
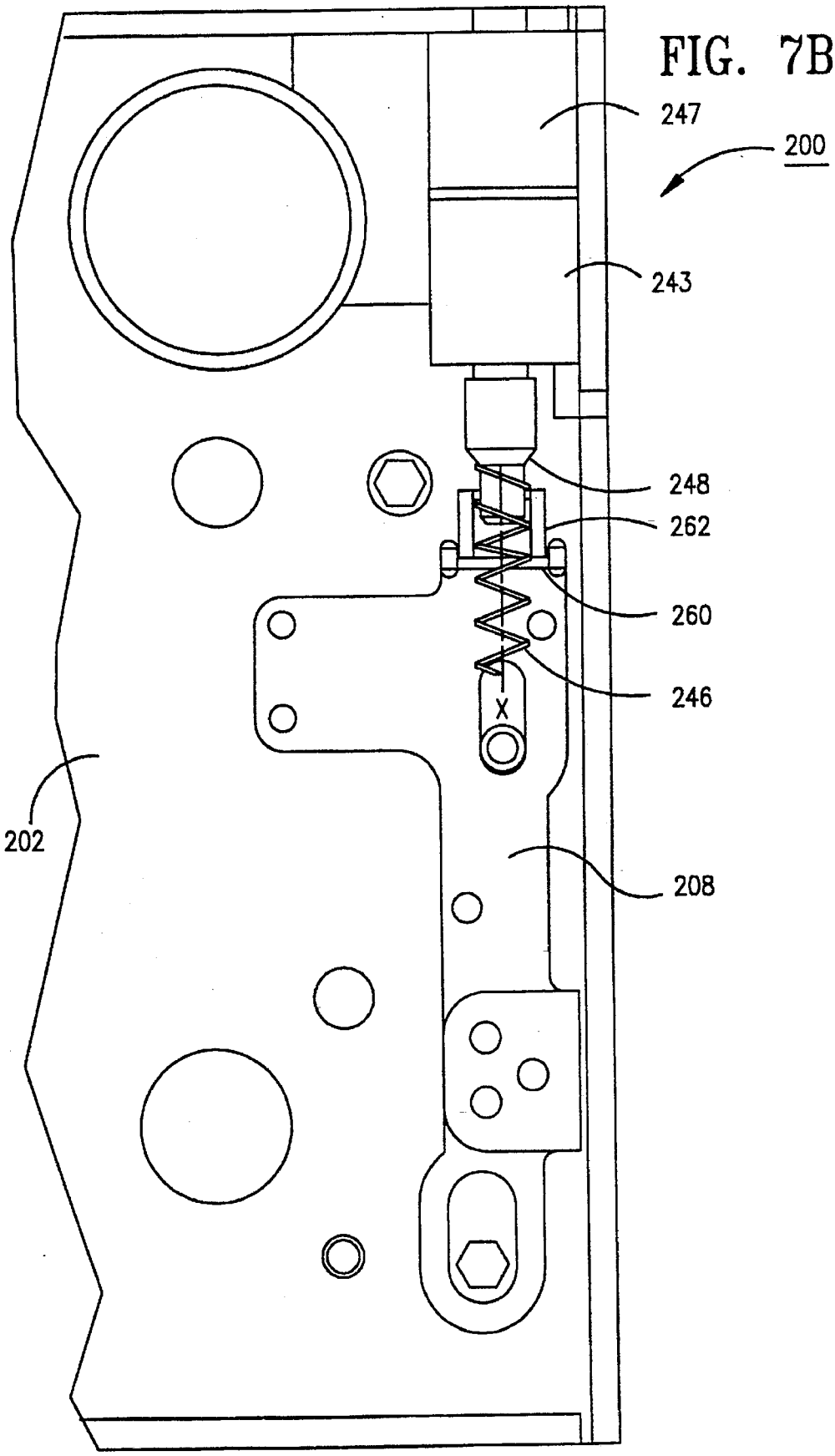
FIG. 7B is a partial side view of the locking device of FIG. 6 in an unlocked position.

During rotation of the motor shaft in a first direction, the pin 260 engages the free end of the spring 246 such that the plug 262 moves away from the motor 247 placing the locking device 200 in the locked position shown in FIG. 7A. During rotation of the motor shaft in a second direction opposite the first direction, however, the pin 260 engages the free end of the spring 246 such that the plug 262 moves toward the motor 247 placing the locking device 200 in the unlocked position shown in FIG. 7B. Thus, the spring 260 translates the rotary motion of the shaft of the motor 247 into a linear motion of the plug 262 to lock and unlock the locking device 200.

If during rotation of the shaft of the motor 247 in the first direction, the plug 262 is prevented from moving to the locked position by an external force, the motor 247 will cause the spring 260 to compress as the plug 262 remains stationary. Then, once the external force is removed, the plug 262 will return to the locked position. Similarly, if during rotation of the shaft of the motor 247 in the second direction, the plug 252 is prevented from moving to the unlocked position by an external force, the motor 247 will cause the spring 260 to stretch as the plug 262 remains stationary. Then, once the external force is removed, the plug 262 will return to the unlocked position.

Again, as was the case with the first embodiment, the pitch of the spring 246 is preferably selected in accordance with the rotational speed of the gear head shaft such that the plug 262 moves along its central axis X at a desired rate. Further, during rotation of the motor shaft, the guide member 248 guides the spring 246 into and out of the plug 262 to thereby facilitate engagement of the spring 246 by the pin 260.

A third embodiment of the locking device according to the present invention will now be described with reference to FIGS. 8, 9A, and 9B. The locking device according to the third embodiment, like the locking device according to the first embodiment, is a cylindrical lock and includes a trim assembly. The trim assembly of the third embodiment is essentially identical to the trim assembly of the first embodiment except for the chassis assembly.

Figure 8:
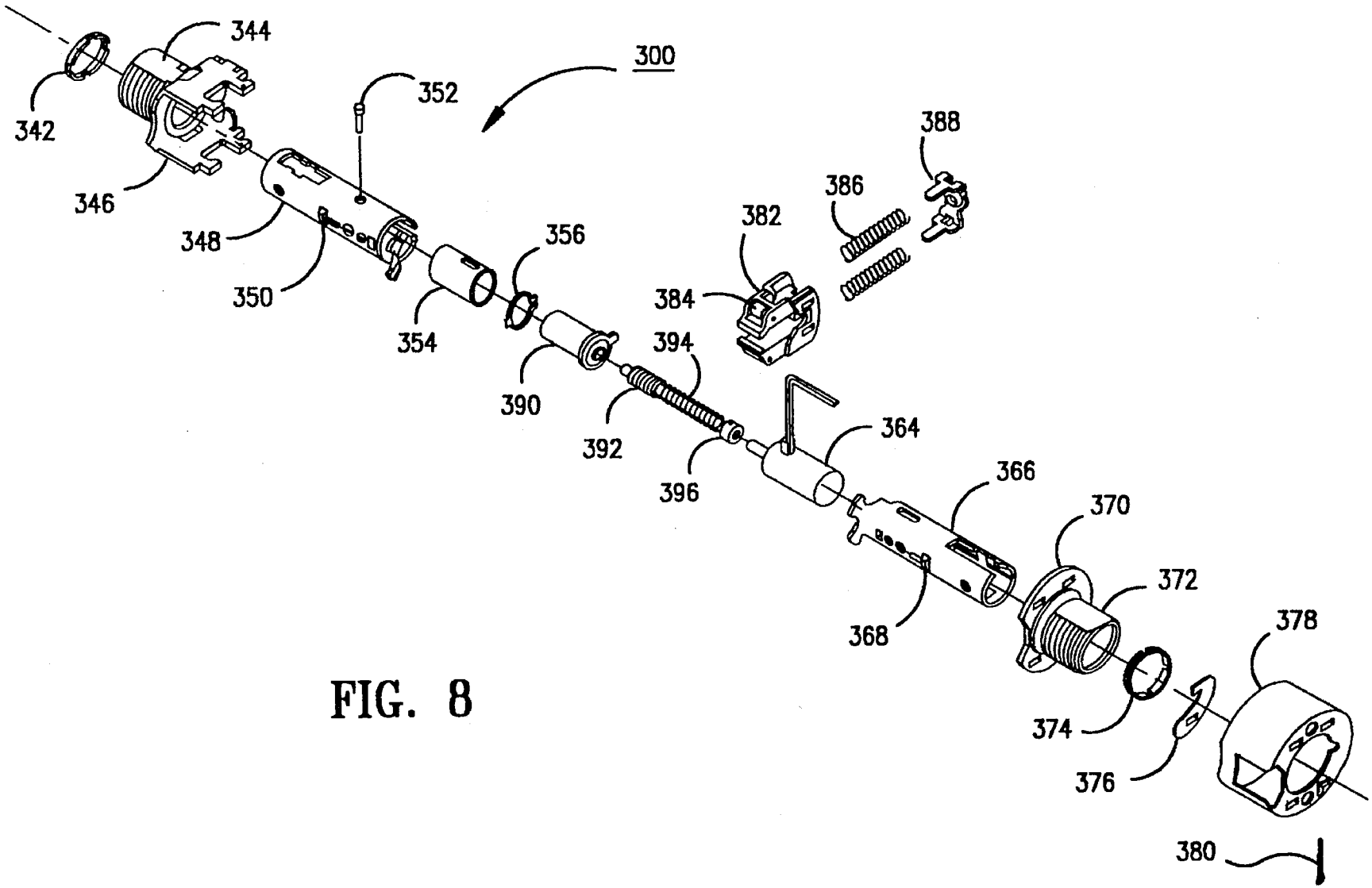
FIG. 8 is an exploded view of a chassis assembly of a locking device according to a third embodiment of the present invention.

As shown in FIG. 8, the chassis assembly 300 of the third embodiment comprises a hub bushing 342, a hub 344, a frame 346, a spindle 348, a catch 350, a pin 352, a plug 354, a washer 356, a motor assembly 364, a spindle 366, a catch 368, a flange 370, a hub 372, a hub bushing 374, a retaining clip 376, a housing 378, a cotter pin 380, a slide 382, rollers 384, slide springs 386, a spring seat 388, a plug 390, a threaded member 392, a spring 394, and a guide member 396. The components of the chassis assembly 300, except for the plug 390, the threaded member 392, the spring 394, the guide member 396, and motor assembly 364, are conventional lock components which are commercially available and, therefore, will not be described in detail.

Figure 9A:
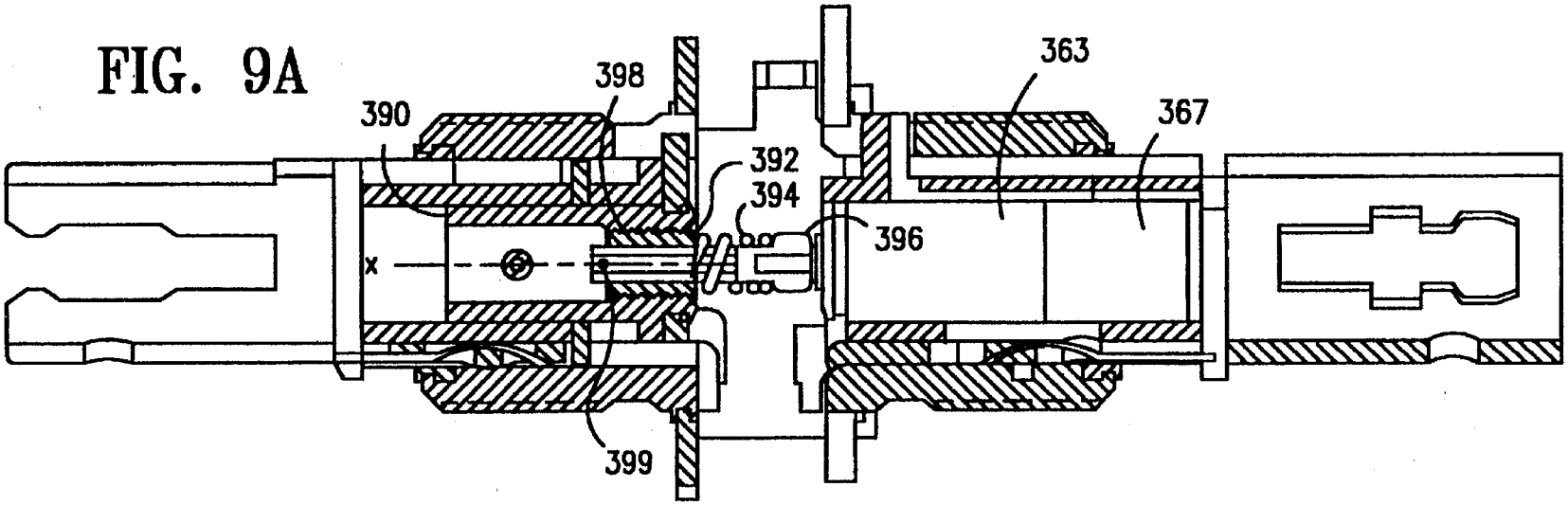
FIG. 9A is a side, cutaway view of the chassis assembly of FIG. 8 in a locked position.
Figure 9B:
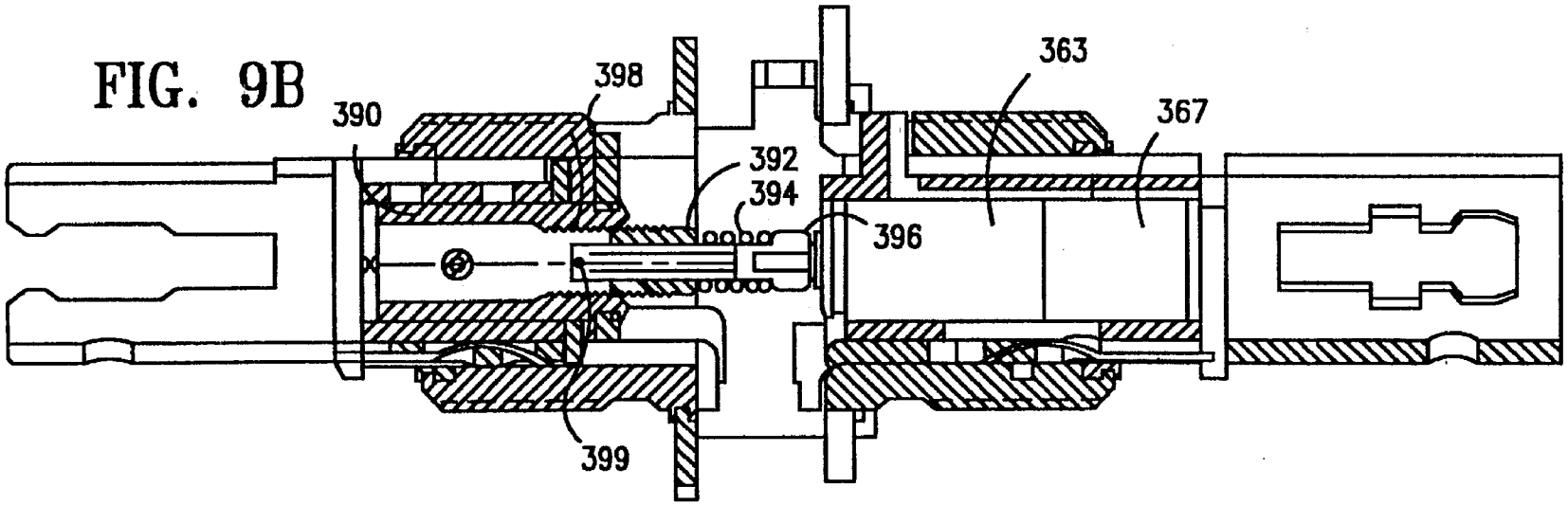
FIG. 9B is a side, cutaway view of the chassis assembly of FIG. 8 in an unlocked position.

As shown in FIGS. 9A and 9B, the plug 390 is a hollow member having a central axis X which is coaxially aligned with the shafts of the gear head 363 and the motor 367. The plug 390 is engaged with the slide 382, the rollers 384, the slide springs 386, the spring seat 388, and a door bolt (not shown) to move these components in a conventional manner alternatively into locked and unlocked positions upon reciprocating linear motion of the plug 390 along the central axis X. The guide member 396 is fixed to the shaft of the gear head 363 via, for example, a set screw, and extends therefrom as shown. Alternatively, the guide member 396 can be integrally formed with the shaft. Again, the motor 367 is preferably a low power DC motor.

The threaded member 392 comprises, for example, a worm gear, and is mounted on the guide member 396 such that it rotates with the shafts of the gear head 363 and the motor 367. The threaded member 392 is free to slide axially along the guide member 396, but is prevented from sliding off the end of the guide member 396 distal from the motor 364 by, for example, a pin 399. The spring 394 is also mounted on the guide member 396 as shown and biases the threaded member 392 towards the plug 390 and away from the motor 364. As also shown in FIGS. 5A and 5B, the chassis assembly 40 further comprises a threaded surface 398 disposed at the interior of the plug 390.

During rotation of the motor shaft in a first direction, the threaded surface 398 engages the threaded member 392 such that the plug 390 moves toward the motor 367 placing the locking device in the locked position shown in FIG. 9A. During rotation of the motor shaft in a second direction opposite the first direction, however, the threaded surface 390 engages the threaded member 392 such that the plug 390 moves away from the motor 367 thereby placing the locking device in the unlocked position shown in FIG. 9B. Thus, the threaded member 392 translates the rotary motion of the shaft of the motor 367 into a linear motion of the plug 390 to lock and unlock the locking device.

If during rotation of the shaft of the motor 367 in the first direction, the plug 390 is prevented from moving to the locked position by an external force, the motor 367 will cause the spring 394 to compress as the plug 390 remains stationary. Then, once the external force is removed, the plug 390 will return to the locked position. Similarly, if during rotation of the shaft of the motor 367 in the second direction, the plug 390 is prevented from moving to the unlocked position by an external force, the motor 367 will cause the spring 394 to stretch as the plug 390 remains stationary. Then, once the external force is removed, the plug 390 will return to the unlocked position.

Preferably, the pitch of the threaded surface 398 is the same as that of the threaded member 392. This pitch is preferably selected in accordance with the rotational speed of the gear head shaft such that the plug 390 moves along its central axis X at a desired rate. Further, during rotation of the motor shaft, the guide member 396 guides the threaded member 392 into and out of the plug 390 to thereby facilitate engagement of the threaded member 392 by the threaded surface 398.

A fourth embodiment of the locking device according to the present invention will now be described with reference to FIGS. 10A and 10B. The locking device 400 of the fourth embodiment is a mortise lock and is substantially identical to the locking device 200 of the second embodiment, only with the following modifications. In the locking device 400, the spring 246, the guide member 248, the plug 262, and the pin 260 of the locking device 200 are replaced by a plug 490, a threaded member 492, a spring 494, a guide member 496, a threaded surface 498, and a pin 499. Preferably, the plug 490, the threaded member 492, the spring 494, the guide member 496, the threaded surface 498, and the pin 499 of the locking device 400 are structurally and functionally similar to the plug 390, the threaded member 392, the spring 394, the guide member 396, the threaded surface 398, and the pin 399, respectively, of the locking device 300 according to the third embodiment.

For example, the plug 490 is a hollow member having a central axis X which is coaxially aligned with the shafts of the gear head 443 and motor 447. The plug 490 is engaged with the electrified link 408 to move the link in a conventional manner alternatively into locked and unlocked positions upon reciprocating linear motion of the plug 490 along the central axis X. The guide member 496 is fixed to the shaft of the gear head 443 via, for example, a set screw, and extends therefrom as shown. Alternatively, the guide member 496 can be integrally formed with the shaft. The spring 494 is fixed to the guide member 496 at one end such the spring 494 rotates with the shafts of the gear head 443 and motor 447. The motor 244 is preferably a low power DC motor.

The threaded member 492 comprises, for example, a worm gear, and is mounted on the guide member 496 such that it rotates with the shaft of the gear head 443. The threaded member 492 is free to slide axially along the guide member 496, but is prevented from sliding off the end of the guide member 496 distal from the motor 447 by, for example, a pin 499. The spring 494 is also mounted on the guide member 496 as shown and biases the threaded member 492 towards the plug 490 and away from the motor 447. Further, the threaded surface 498 is disposed at the interior of the plug 490.

Figure 10A:
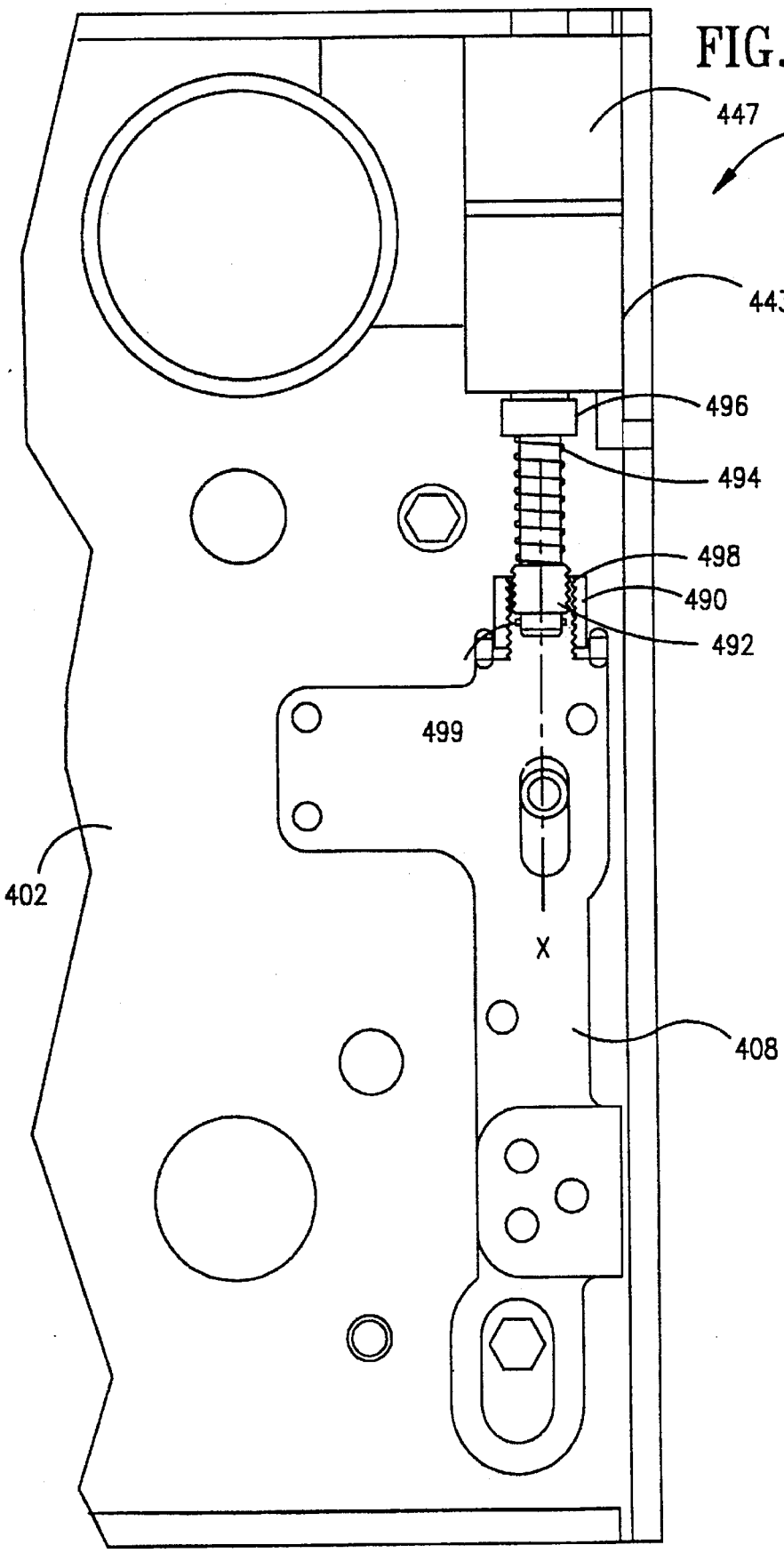
FIG. 10A is a partial side view of a locking device according to a fourth embodiment of the present invention in a locked position.
Figure 10B:
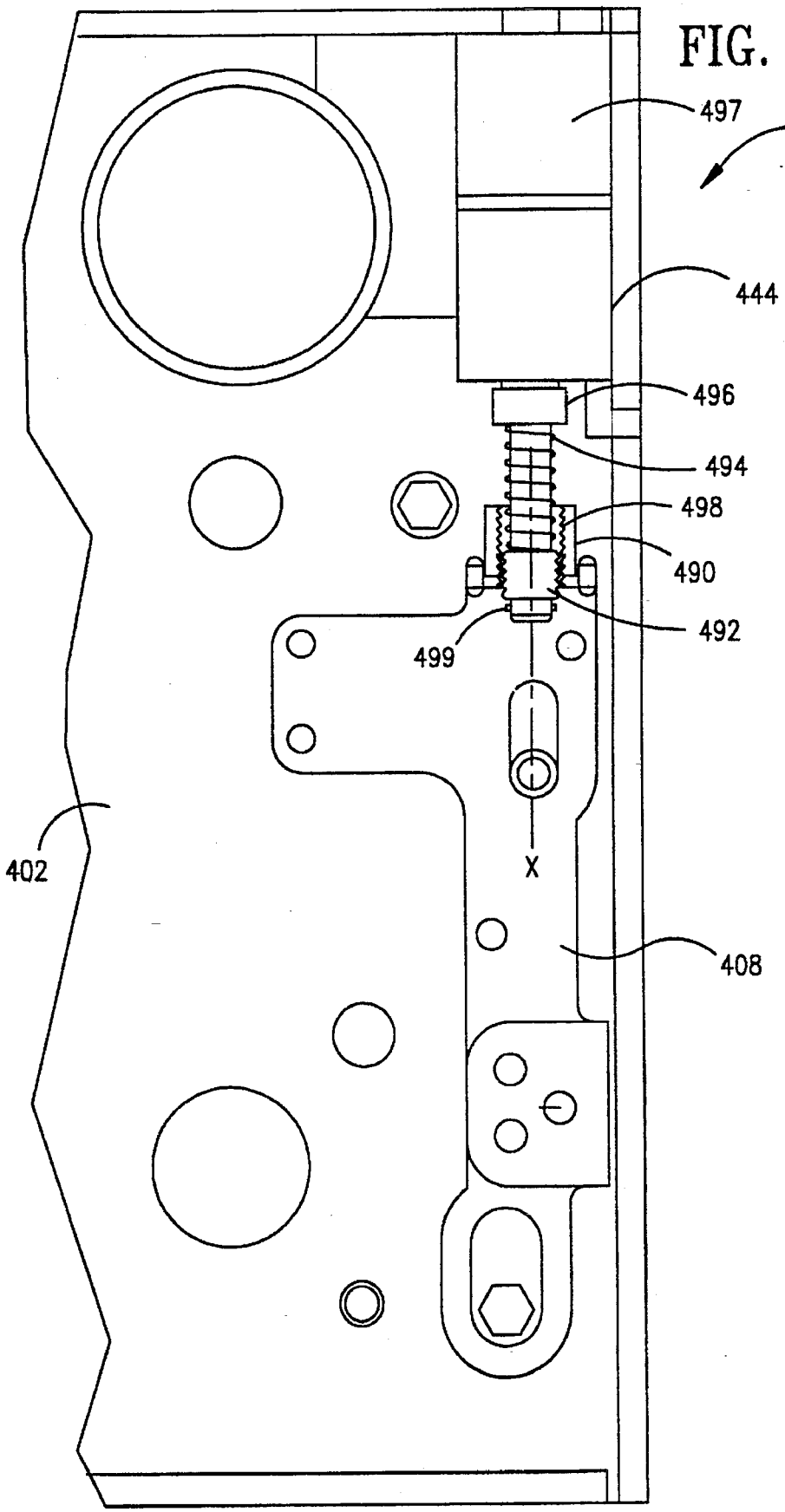
FIG. 10B is a partial side view of a locking device according to the fourth embodiment in an unlocked position.

During rotation of the motor shaft in a first direction, the threaded surface 498 engages the threaded member 492 such that the plug 490 moves away from the motor 447 placing the locking device in the locked position shown in FIG. 10A. During rotation of the motor shaft in a second direction opposite the first direction, however, the threaded surface 490 engages the threaded member 492 such that the plug 490 moves toward the motor 447 thereby placing the locking device in the unlocked position shown in FIG. 10B. Thus, the threaded member 492 of the locking device 400 translates the rotary motion of the shaft of the motor 447 into a linear motion of the plug 490 to lock and unlock the locking device 400.

If during rotation of the shaft of the motor 447 in the first direction the plug 490 is prevented from moving to the locked position by an external force, the motor 447 will cause the spring 494 to compress as the plug 490 remains stationary. Then, once the external force is removed, the plug 490 will return to the locked position. Similarly, if, during clockwise rotation of the shaft motor 447, the plug 490 is prevented from moving to the unlocked position by an external force, the motor 447 will cause the spring 494 to stretch as the plug 490 remains stationary. Then, once the external force is removed, the plug 490 will return to the unlocked position.

As was the case with the third embodiment, the pitch of the threaded surface 498 is preferably the same as that of the threaded member 492 and is preferably selected in accordance with the rotational speed of the gear head shaft such that the plug 490 moves along its central axis X at a desired rate. Again, during rotation of the motor shaft, the guide member 496 guides the threaded member 492 into and out of the plug 490 to thereby facilitate engagement of the threaded member 492 by the threaded surface 498.

Figure 11:
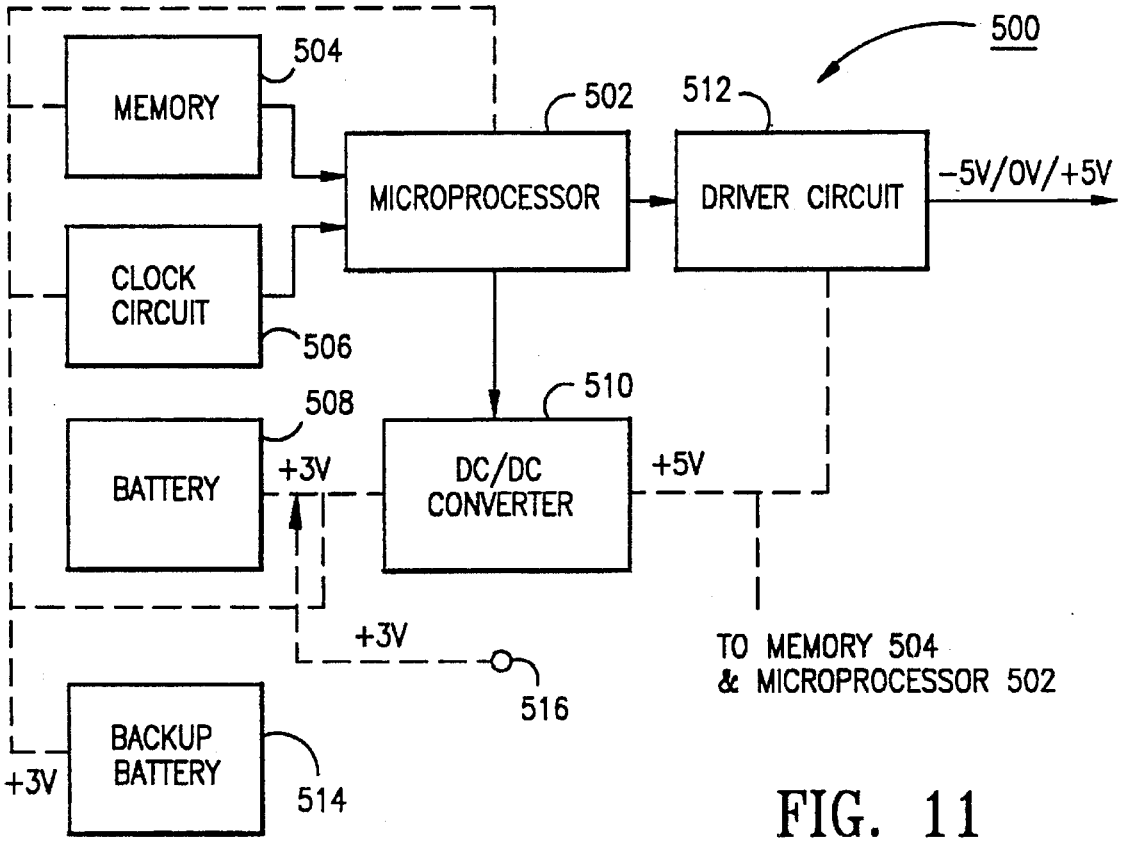
FIG. 11 is a block diagram of the control electronics according to the present invention.
Figure 12:
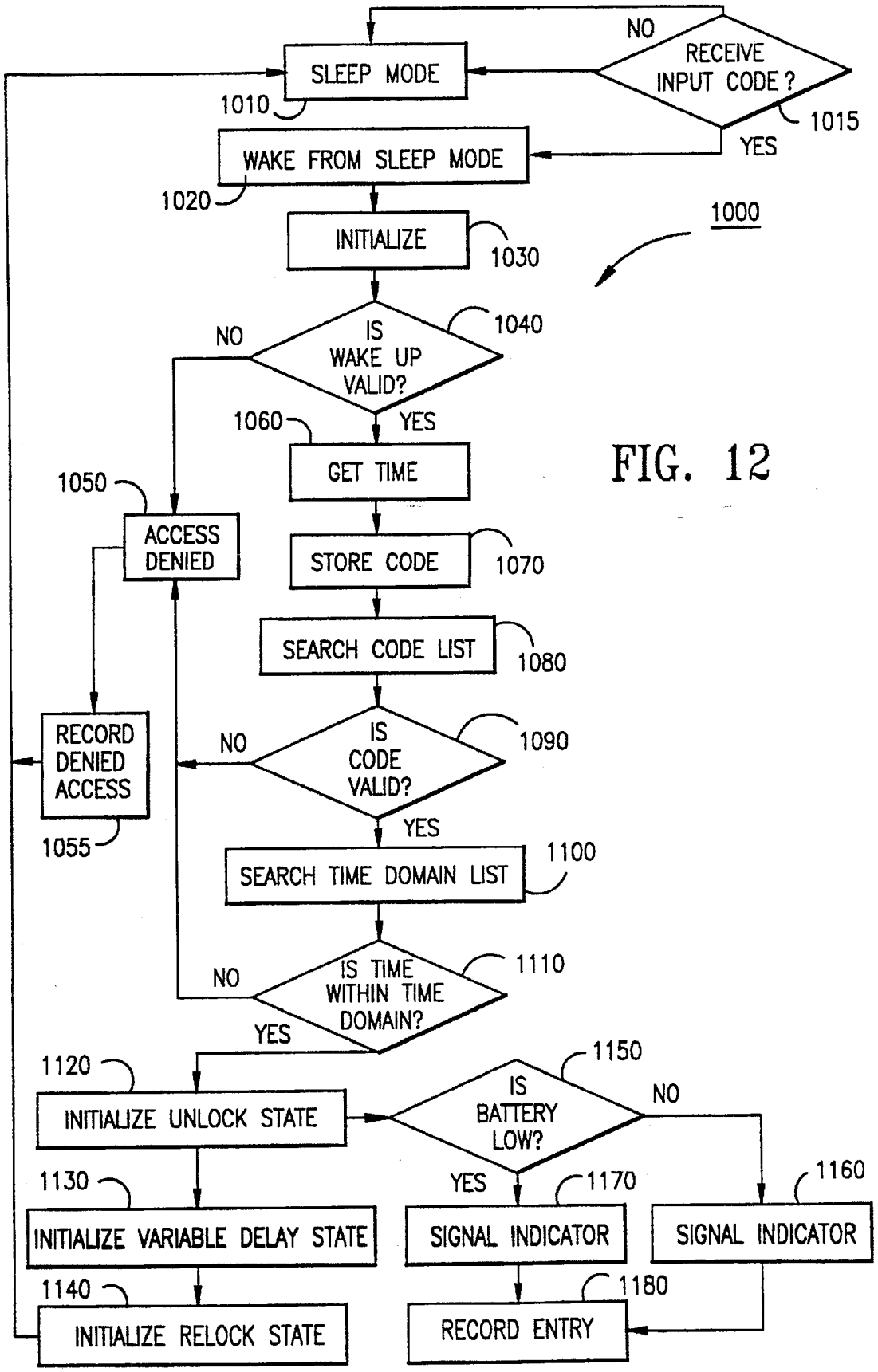
FIG. 12 is a flow diagram of the operations performed by the control electronics of FIG. 11.

An example of the control electronics for operating the locking devices of the first through fourth embodiments is shown in FIG. 11 and is designated generally by reference numeral 500. As embodied herein and referring to FIG. 11, the control electronics 500 comprises a microprocessor 502, a memory 504, a clock circuit 506, a battery 508, a DC/DC converter 510, a driver circuit 512, a backup battery 514, and an external electrode 516.

The microprocessor comprises, for example, a commercially available single-chip microprocessor such as a Dallas Semiconductor 5001, Intel 80C5X, Motorola 68000, or equivalent microprocessor. The microprocessor 502 controls the functions of the control electronics 500 as will be explained in detail below.

The memory 504 can be a volatile and/or nonvolatile memory for storing data as well as programs for running the microprocessor 502. The volatile memory can include, for example, a RAM and the nonvolatile memory can include, for example, a ROM or EPROM.

The clock circuit 506 is a standard clock circuit for keeping track of the real time. As will be explained in detail below, during operation of the control electronics 500, the microprocessor 502 periodically accesses the real time from the clock circuit 506.

The battery 508 comprises, for example, a conventional lithium cell capable of providing a +3 v output. An example of such a cell is a CR123A cell manufactured by Panasonic or an equivalent cell.

The backup battery 514 also comprises, for example, a conventional lithium cell capable of providing a +3 v output. An example of such a cell is a CR1632 cell manufactured by Panasonic or an equivalent cell.

The DC/DC converter 510 is a conventional DC/DC converter capable of converting the +3 v output from the battery 508 into a +5 v output. As will be explained in more detail below, the +5 v output from the DC/DC converter 510 is supplied to the microprocessor 502, the memory 504, and the driver circuit 512 during normal operation of the control electronics 500.

The driver circuit 512 comprises, for example, a conventional driver circuit capable of providing −5 v, 0 v, and +5 v drive signals from the +5 v applied by the DC/DC converter 510 for driving the DC motor of the present invention. As will be explained below, the driver circuit 512 is controlled by the microprocessor 502.

Operation of the control electronics 500 will now be described with reference to the flow diagram 1000 of FIG. 11.

In step 1010, the control electronics 500 are in a low power "sleep mode." In the sleep mode, the DC/DC converter is non-operational and the microprocessor 502, the memory 504, and the clock circuit 506 draw only enough power from the backup battery 514 to sustain certain basic functions, e.g., storing volatile data and keeping track of the real time.

As indicated in step 1015, the control electronics 500 remain in the sleep mode until an input code is received by the microprocessor 502. As described above, the input code can be generated by any number of devices known in the art including an infrared or RF receiver, a keypad, a bar code reader, a pattern recognition device, a voice recognition device, a Touch Memory® device, or the like.

In step 1020, upon receiving an input code, the control electronics 500 wake from the sleep mode and, in step 1030, the microprocessor 502 performs an initialization routine whereby the DC/DC converter 510 is rendered operative such that it provides a +5 v power supply to the microprocessor 502, the memory 504, and the driver circuit 512. Control then passes to step 1040.

In step 1040, the microprocessor 502 determines whether the wakeup from the sleep mode was valid. Specifically, the microprocessor 502 analyzes the input code to determine whether it is an input code recognizable by the microprocessor 502. If the microprocessor 502 recognizes the input code, control passes to step 1060. Otherwise, control passes to steps 1050 and 1055, whereby access is denied and the denied access is recorded by the microprocessor 502. Then, control returns to step 1010 and the control electronics 500 reenter the sleep mode. In this manner, the microprocessor 502 can account for false wakeups due to, for example, a short circuit or other erroneous input signals.

In step 1060, the microprocessor 502 retrieves the real time from the clock circuit 506. Control then passes to step 1070 wherein the microprocessor 502 stores the input code in the memory 504 along with the real time retrieved in step 1060.

In step 1080, the microprocessor 502 searches a code list previously stored in the memory 504 to determine if there is a match between a code in the code list and the input code.

In step 1090, if the microprocessor 502 finds a match between a code in the code list and the input code, the microprocessor 502 determines that the input code is valid and control passes to step 1100. Otherwise, control passes to steps 1050 and 1050, whereby access is denied and the denied access recorded. Control then returns to step 1010 and the control electronics 500 reenter the sleep mode.

In step 1100, the microprocessor 502 searches a time domain list previously stored in the memory 504 to determine whether the real time retrieved in step 1060 is within a time range associated with the input code. Specifically, the time domain list is a list of times associated with each code stored in the code list during which the codes can initiate an unlocking of the locking device. In this manner, it is possible to restrict unlocking of the locking device during specific times of the day for each code stored in the code list. For example, if the locking device is being used in a place of business, it may be desirable to allow certain persons, e.g., cleaning people, to unlock the device only during certain times of the day, e.g., after regular business hours.

In step 1110, the microprocessor 502 determines whether the real time retrieved in step 1060 falls within the time domain associated with the input code. If the real time does fall within the time domain, control passes to step 1120. Otherwise, control passes to steps 1050 and 1055, whereby access is denied and recorded. Then, control returns to step 1010 and the control electronics 500 reenter the sleep mode.

In step 1120, the microprocessor 1120 initializes an unlocked state of the locking device. Specifically, the microprocessor 502 controls the driver circuit 512 such that the driver circuit 512 produces a +5 v pulse of approximately 0.500 seconds. The +5 v pulse is supplied to the motor causing it to rotate in one direction and thereby place the locking device in an unlocked position as described above.

In step 1130, the microprocessor 502 initializes a variable delay state, whereby the driver circuit 512 produces a 0 v output and the locking device remains in the unlocked position for a predetermined period of time. The purpose of the variable delay state is to provide a predetermined period of time, e.g., normal business hours, during which operation of the locking device is not necessary to gain entrance to a normally secured area. Upon completion of the variable delay state, control passes to step 1140.

In step 1140, the microprocessor 502 initializes a re-lock state of the locking device. Specifically, the microprocessor 502 controls the driver circuit 512 in order that the driver circuit 512 produces a −5 v pulse of approximately 0.500 seconds. The −5 v pulse is supplied to the motor which causes it to rotate in the opposite direction and thereby place the locking device in a locked position. Once the locking device has been returned to the locked position, control returns to step 1010 and the control electronics 500 reenter the sleep mode.

Once the microprocessor 502 has initialized the unlock state in step 1120, it tests the battery 508 to determine whether its stored power is low. Testing of the battery 508 can be accomplished by various techniques known in the art, such as measuring internal resistance or output voltage. Alternatively, the microprocessor 502 can count the number of times the locking device has been operated and, from that count, calculate the remaining life of the battery 508 based upon paradigms for battery life. This count can be stored in the memory 504.

In steps 1160 and 1170, the microprocessor 502 produces an appropriate signal indicator, e.g., energizes a green or red LED, to indicate whether or not the battery 502 is low. In step 1180, the microprocessor 502 updates the count stored in the memory 504 for use in a subsequent battery test operation.

If during operation of the locking device the battery 508 should fail, an external +3 v power source can be connected to the terminal 516 to supply the necessary power to the control electronics 500 to continue operation. Preferably, the terminal 516 is located at the secured side of the locking device (FIG. 1) and is easily accessible for this purpose. Also, if the control electronics, e.g., the microprocessor 502 or battery 508, should fail, the locking device can preferably be operated manually using a mechanical key by inserting the key into the barrel of the locking device (e.g., the barrel 16 of FIG. 1) and turning the key in a conventional manner.

It will be apparent to those skilled in the art that various modifications and variations can be made in the locking device of the present invention without departing from the spirit or scope of the invention. Thus, it is intended that the present invention cover the modifications and variations of the invention provided they come within the scope of the appended claims and their equivalents.

What is claimed is:

1. A locking device, comprising:

a locking mechanism having a locked position and an unlocked position;

a hollow plunger member having a central axis, the hollow plunger member being engaged with the locking mechanism to move the locking mechanism alternatively into the locked and unlocked positions upon reciprocating linear motion of the hollow plunger member in first and second directions along its central axis;

a motor having a shaft disposed coaxial with the central axis of the hollow plunger member;

a spring having first and second ends, the first end being fixed to the motor shaft; and a pin fixed to the hollow plunger member for engaging the second end of the spring such that when the motor shaft rotates in a third direction the hollow plunger member moves in the first direction and when the motor shaft rotates in a fourth direction the hollow plunger member moves in the second direction; and control electronics for controlling the direction of rotation of the motor shaft by providing a pulse in response to an input signal produced by an input signal generator; wherein the pin extends radially from an interior surface of the hollow plunger member.

2. The locking device of claim 1, wherein the pin is perpendicular to the central axis of the hollow plunger member.

3. The locking device of claim 1, further comprising a guide member extending from the motor shaft to facilitate engagement of the spring by the pin.

4. A locking device, comprising:

a locking mechanism having a locked position and an unlocked position;

a hollow plunger member having a central axis, the hollow plunger member being engaged with the locking mechanism to move the locking mechanism alternatively into the locked and unlocked positions upon reciprocating linear motion of the hollow plunger member in first and second directions along its central axis;

a motor having a shaft disposed coaxial with the central axis of the hollow plunger member;

a spring having first and second ends, the first end being fixed to the motor shaft; and a pin fixed to the hollow plunger member for engaging the second end of the spring such that when the motor shaft rotates in a third direction the hollow plunger member moves in the first direction and when the motor shaft rotates in a fourth direction the hollow plunger member moves in the second direction; and control electronics for controlling the direction of rotation of the motor shaft by providing a pulse in response to an input signal produced by an input signal generator;

wherein at least a portion of the spring extends into the hollow plunger member during reciprocating linear motion of the hollow plunger member.

5. The locking device of claim 1, wherein the input signal generator includes at least one of a keypad, bar code reader, pattern recognition device, infrared receiver, voice recognition device, RF receiver, and Touch Memory® device.

6. A locking device, comprising:

a locking mechanism having a locked position and an unlocked position;

a hollow plunger member having a central axis, the hollow plunger member being engaged with the locking mechanism to move the locking mechanism alternatively into the locked and unlocked positions upon reciprocating linear motion of the hollow plunger member in first and second directions along its central axis;

a motor having a shaft disposed coaxial with the central axis of the hollow plunger member;

a spring having first and second ends, the first end being fixed to the motor shaft; and a pin fixed to the hollow plunger member so as to prevent relative motion between the pin and the hollow plunger member for engaging the second end of the spring such that when the motor shaft rotates in a third direction the hollow plunger member moves in the first direction and when the motor shaft rotates in a fourth direction the hollow plunger member moves in the second direction; and control electronics for controlling the direction of rotation of the motor shaft by providing a pulse in response to an input signal produced by an input signal generator.

7. A locking device, comprising:

a locking mechanism having a locked position and an unlocked position;

a hollow plunger member having a central axis, the hollow plunger member being engaged with the locking mechanism to move the locking mechanism alternatively into the locked and unlocked positions upon reciprocating linear motion of the plunger member in first and second directions along its central axis;

a motor having a shaft disposed coaxial with the cental axis of the hollow plunger member;

a threaded member disposed on a guide member such that the threaded member is free to slide in the first and second directions; and a threaded surface formed on an interior of the hollow plunger member to threadably engage the threaded member such that when the motor shaft rotates in a third direction the hollow plunger member moves in the first direction and when the motor shaft rotates in a fourth direction the hollow plunger member moves in the second direction; and wherein the guide member extends from the motor shaft to facilitate engagement of the threaded member by the threaded surface.

8. The locking device of claim 7, wherein the locking device further comprises a biasing member for biasing the threaded member away from the motor.

9. The locking device of claim 7, wherein at least a portion of the threaded member extends into the hollow plunger member during reciprocating linear motion of the hollow plunger member.

10. The locking device of claim 7, further comprising control electronics responsive to an input signal for controlling the direction of rotation of the motor shaft.

11. The locking device of claim 10, further comprising input signal generator for generating the input signal.

12. The locking device of claim 11, wherein the input signal generator includes at least one of a keypad, bar code reader, pattern recognition device, infrared receiver, voice recognition device, and RF receiver.

* * * * *